US007357480B2

(12) United States Patent
Kulpa

(10) Patent No.: US 7,357,480 B2
(45) Date of Patent: Apr. 15, 2008

(54) SYSTEM FOR INDEPENDENT TRANSLATIONAL MOTION ON TWO AXES USING ONE MOTOR

(75) Inventor: Walter J. Kulpa, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 363 days.

(21) Appl. No.: 10/952,615

(22) Filed: Sep. 29, 2004

(65) Prior Publication Data

US 2006/0066668 A1 Mar. 30, 2006

(51) Int. Cl.
*B41J 23/00* (2006.01)

(52) U.S. Cl. ..... 347/37; 347/38

(58) Field of Classification Search ..... 347/37, 347/38; 74/50; 400/59
See application file for complete search history.

(56) References Cited

U.S. PATENT DOCUMENTS 4,401,025 A 8/1983 Vogelhuber et al. ..... 101/93.05
5,563,591 A * 10/1996 Jacobs et al. ..... 341/13
5,623,876 A 4/1997 Murphy et al. ..... 101/483
5,717,165 A 2/1998 Cohen et al. ..... 177/2
6,007,178 A 12/1999 Asano ..... 347/30
6,270,185 B1 * 8/2001 Askeland ..... 347/40
6,641,313 B2 11/2003 Bobry ..... 400/88
6,715,947 B1 * 4/2004 Cornelius et al. ..... 400/322
2002/0041783 A1 4/2002 Bobry ..... 400/323

* cited by examiner

*Primary Examiner*—Manish S. Shah
*Assistant Examiner*—Geoffrey Mruk
(74) *Attorney, Agent, or Firm*—George M. Macdonald; Angelo N. Chaclas

(57) ABSTRACT

A system for independent translational motion on two axes using one motor is described. In one configuration, a modified dual Scotch Yoke using slots resembling the letter J is utilized to drive both the maintenance station and ink jet head of a mailing machine.

20 Claims, 8 Drawing Sheets

SYSTEM FOR INDEPENDENT TRANSLATIONAL MOTION ON TWO AXES USING ONE MOTOR

BACKGROUND

The illustrative embodiments described in the present application are useful in systems including those for providing independent translational motion on two axes using one motor and more particularly are useful in systems including those for providing an ink jet printing system having a single motor to drive a maintenance station and for moving a print head into a printing position.

Systems for moving print heads and maintenance stations in mailing machines have been described. For example, U.S. Pat. No. 5,623,876 issued Apr. 29, 1997 to Murphy, III, et al., describes an apparatus and method for positioning a printing mechanism between stations in a mail handling apparatus. Similarly, U.S. Pat. No. 5,717,165, issued Feb. 10, 1998 to Cohen, et al., describes an apparatus and method for positioning and isolating a printing mechanism in a mail-handling machine.

One traditional mechanism that has been utilized for translating rotary motion to linear motion in machines including motors is known as the Scotch Yoke. In such a mechanism, a rotary motor with a crank drives a pin with a rotary motion wherein the pin is displaced in a slot of an arm in a linear channel. The resulting reciprocating linear motion of the arm is perpendicular to the slot and is sinusoidal.

U.S. Pat. No. 6,641,313, issued Nov. 4, 2003 to Bobry describes a motion control for multiple path raster scanned printer. It describes a device that utilizes a traditional Scotch Yoke mechanism couple to one of two motors used for movement drives.

U.S. Pat. No. 6,007,178, issued Dec. 28, 1999 to Asano describes a drive gear system using a single motor for a priming operation and driving a platen in a postage meter in which a swing gear is utilized to alternate gear trains driven by a motor.

U.S. Pat. No. 4,401,025, issued Aug. 30, 1983 to Vogelhuber, et al. describes a device for pivoting a printing unit that describes a slotted crosshead or Scotch yoke which is described as part of a pivoting mechanism.

Accordingly, the prior art does not provide a mailing machine for using one motor for independent translational motion on two axes to drive a maintenance station and a print head.

SUMMARY

Accordingly, it is an object of the present application to describe a modified dual Scotch Yoke mechanism for providing no linear motion during a portion of the rotary motion cycle.

Accordingly, it is another object of the present application to describe a mailing machine for using one motor for independent translational motion on two axes to drive a maintenance station and a print head.

The illustrative embodiments of the present application describe a modified scotch yoke mechanism for allowing lost motion on one axis of the drive mechanism while translation is taking place on the other axis.

In one illustrative embodiment, a printing system includes a print head and a maintenance station. A dual modified scotch yoke mechanism is used to translate the rotary motion of a single motor to both move a maintenance station across the face of a print head and also to move the print head into a print position. Each slot of the modified scotch yoke resembles the letter J. When the motor is in the first 180 degrees of motor rotation, the pin is in the linear portion of the J and the arm moves the first object. When the motor is in the second 180 degrees of rotation, the pin moves freely in the arc of the curved portion of the slot such that the arm does not move the first object. The second arm and slot are engaged 180 degrees out of phase such that the second object moves only in the second 180 degrees of motor rotation.

In another embodiment, a bias spring is utilized to ensure proper positioning of the print head carriage when it is place in a print position.

In yet another embodiment, a ramp system is utilized to take advantage of the mechanical advantage of the modified scotch yoke mechanism as the maintenance station returns to its original position in order to cap the print head.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

In the illustrative motion translation mechanism and mailing machine embodiments provided, a modified scotch yoke mechanism is described.

In certain prior mailing machine systems having an ink jet printing subsystem, one motor was used to drive a maintenance station and a second motor was used to drive the print head. The illustrative embodiments described provide advantages over the prior art including using a single motor to drive both the maintenance station and print head, thereby reducing cost. Additionally, the illustrative embodiments described provide the further advantage of preventing the print head from moving while it is printing on the media or mail piece that is moving past it. Furthermore, the illustrative embodiments described provide the further advantage of holding the print head in a known position during the capping procedure.

Figure 1:
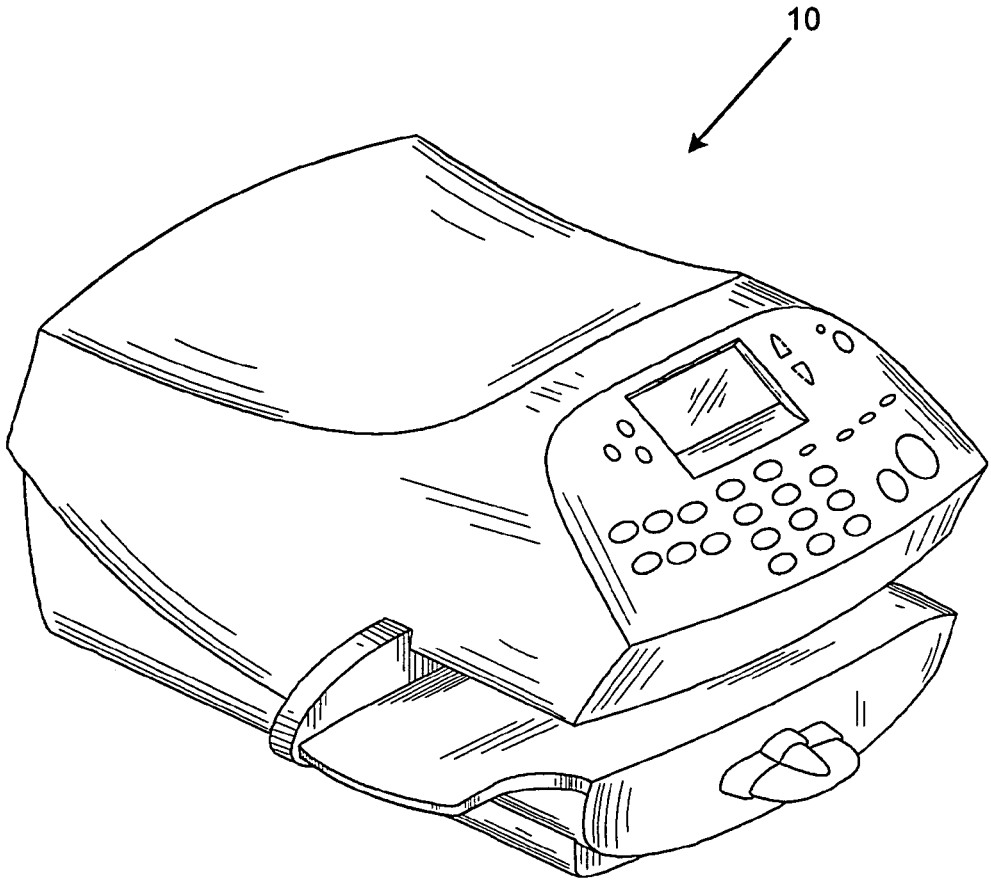
FIG. 1 is a plan view of a mailing machine according to an illustrative embodiment of the present application.

Referring now to the drawings, and particularly to FIG. 1, the reference numeral 10 generally indicates a postage meter provided in accordance with the invention. As more fully described with reference to FIGS. 3A-3C and FIGS. 4A-4C, the postage meter 10 includes an ink jet printing system including a maintenance station operatively engaged to guide rails and a print head or print head carriage operatively engaged to guide rails. A single motor is used to drive the maintenance station and print head using a modified scotch yoke mechanism.

Linear guide rails are commonly present in ink jet printers to guide print head carriages that may be driven by a screw drive or a belt. A scotch yoke mechanism provides harmonic motion without the need for a "smart" motor programmed to provide harmonic motion. Additionally, such a mechanism also results in defined locations at the extremes of motion that cannot be back-driven.

The illustrative embodiments described utilize the harmonic translational motion and self-locking properties of the modified scotch yoke mechanism to move and position the maintenance station and the ink jet head of a mailing machine. While the translation mechanism subsystem and ink jet printing subsystem are described in relation to a mailing machine, such subsystems may be used in other systems. The traditional scotch yoke mechanism is modified to allow lost motion on one axis of the drive mechanism while translation is taking place on the other axis.

At least one illustrative embodiment described allows the motor driving each axis to accelerate from a condition of essentially zero load and to provide motion with a minimum amount of noise. The system provides known fixed locations for the maintenance station and print head at the extremes of the paths of travel without the need to energize the motor. The system uses only one motor and driver to provide motion on two axes. The print head of the system can be maintained in the printing position and can resist significantly more dislodging force than can be provided using a motor holding current because the mechanism is in a position that cannot be backdriven. It can be spring loaded at that position with a relatively high force. The high spring force is possible because of the high mechanical advantage of the modified scotch yoke mechanism as it enters and leaves the print position. In certain prior systems, motion was provided on the two axes using two separate motors and drivers that operated separate timing belts or lead screws. The use of a timing belt requires the use of a tensioning mechanism and a holding current applied to each motor to maintain position. The use of a lead screw requires the use, at a minimum, of an anti-backlash nut to locate at least the print head.

Figure 2A:
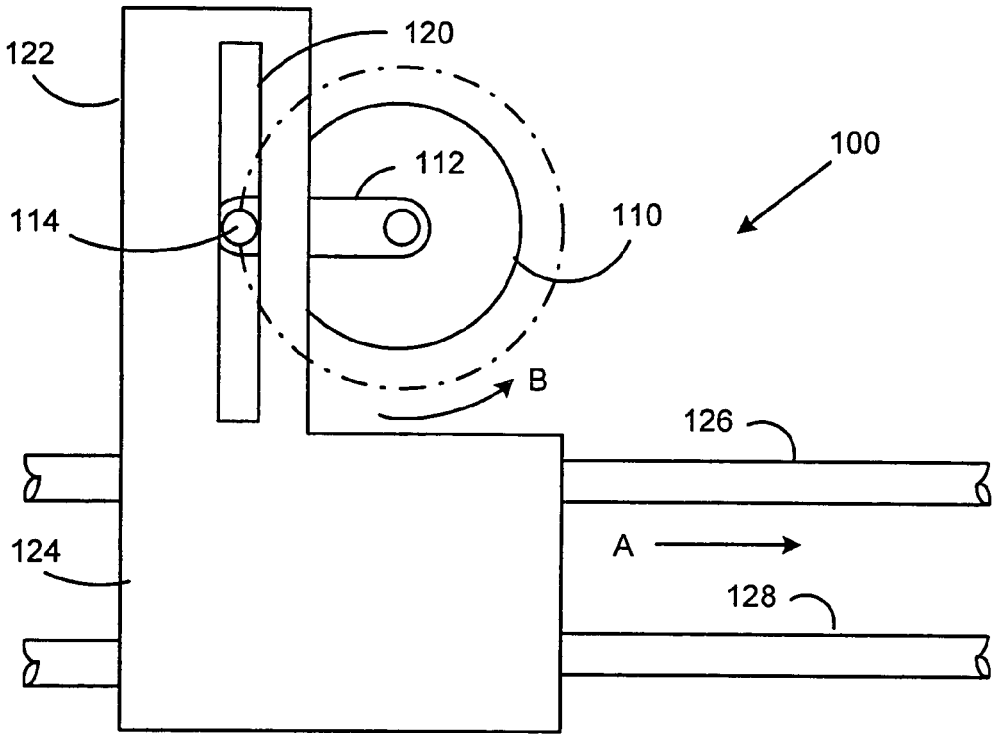
FIGS. 2A and 2B are schematic views of a Scotch Yoke used to drive a carriage along guide rails.
Figure 2B:
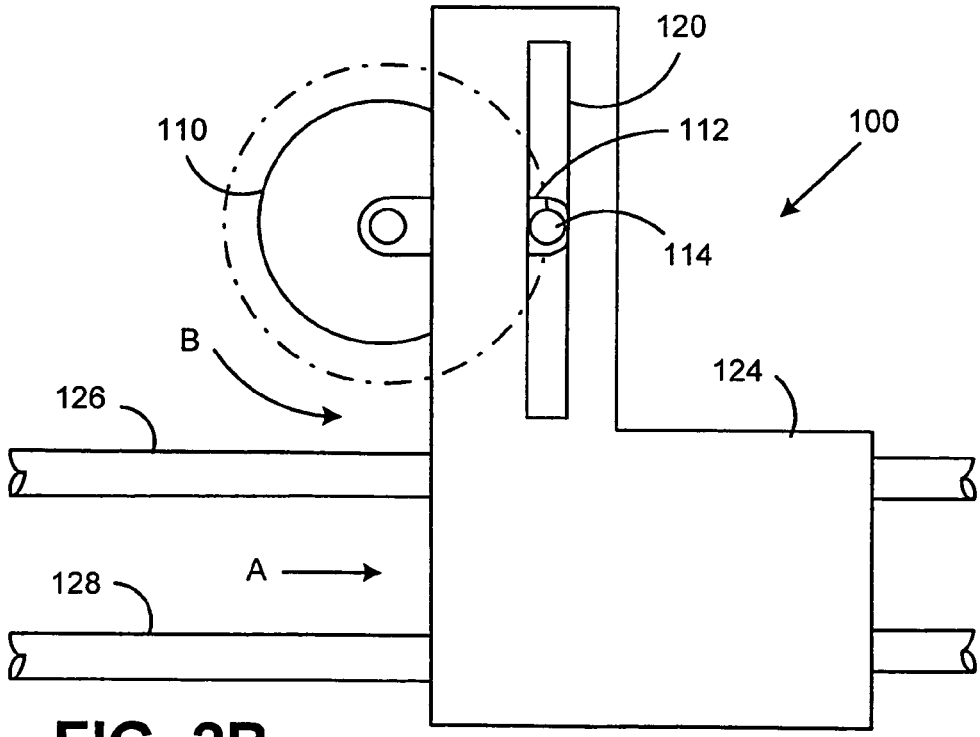

Referring to FIGS. 2A-2B, a Scotch Yoke system 100 used to drive a carriage 124 along guide rails 126, 128 is shown. The mechanism includes a slot 120 in the arm 122 of the carriage 124. The arm 122 or carriage 124 or other object attached to the arm is confined to move in a linear path on guide rails 126, 128 placed perpendicular to the slot 120. A pin 114 is connected to a crank shaft 112 that is driven by motor 110. The motor 110 drives the pin 114 in a circular path and it engages the slot 120 in the arm 122. As the motor 110 moves the pin 114 along its circular path, it drives the carriage 124 or other object along the rails 126, 128. The acceleration, velocity and the displacement of the object are harmonic in nature. The velocity goes to zero at each extreme of the reciprocating linear motion of the object regardless of the speed of the pin around its circular path. With the pin stopped at either extreme of motion along the reciprocating linear path of the object, the object or carriage 12 has zero mechanical advantage in displacing the pin and moving. As shown in FIG. 2A, the motor 110 starts in the position shown and then rotates 180 degrees in direction B. As the pin 114 engages the slot 120, the arm 122 and therefore the connected carriage 124 travels in direction A along the rails 126, 128. At the end of the 180-degree motor rotation the carriage is located in the position shown in FIG. 2B. In this mechanism, the desired linear displacement of the carriage 124 is achieved by having the pin move through 180 degrees of motor rotation and then stopping. The carriage 124 or other object can then be returned to its original position by having the motor move through another 180 degrees of rotation in either the same direction or the reverse direction.

Figure 3A:
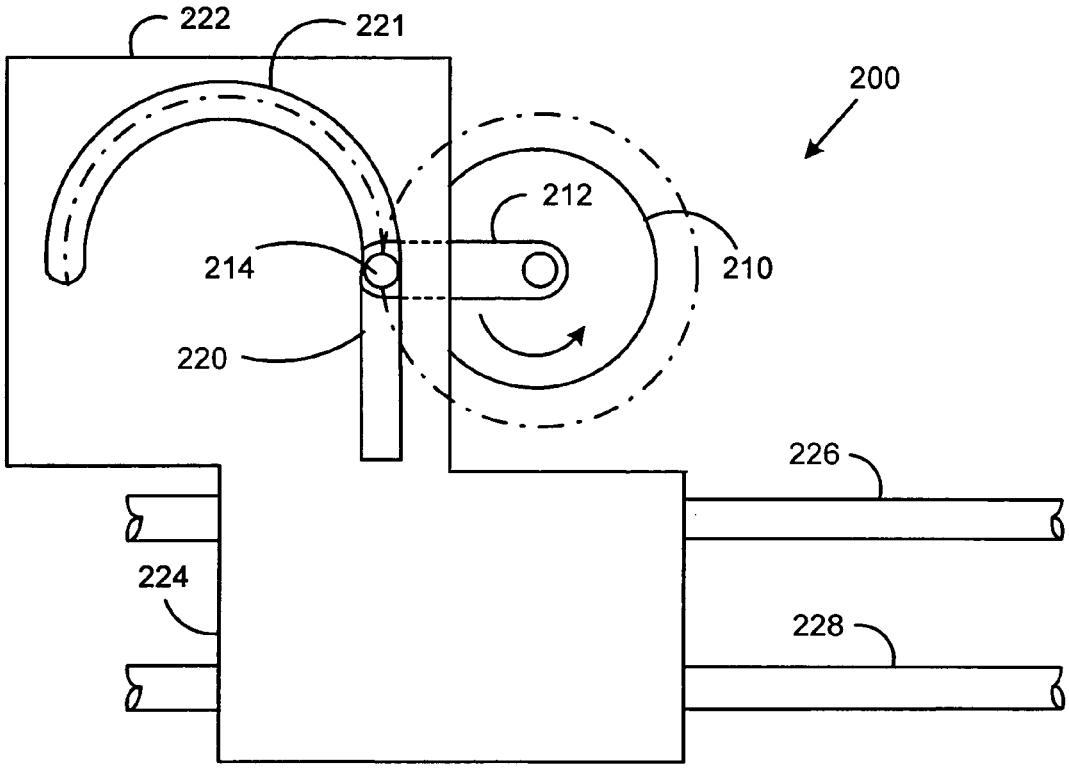
FIGS. 3A, 3B and 3C are schematic views of a modified Scotch Yoke used to drive a first carriage along guide rails according to an illustrative embodiment of the present application.
Figure 3B:
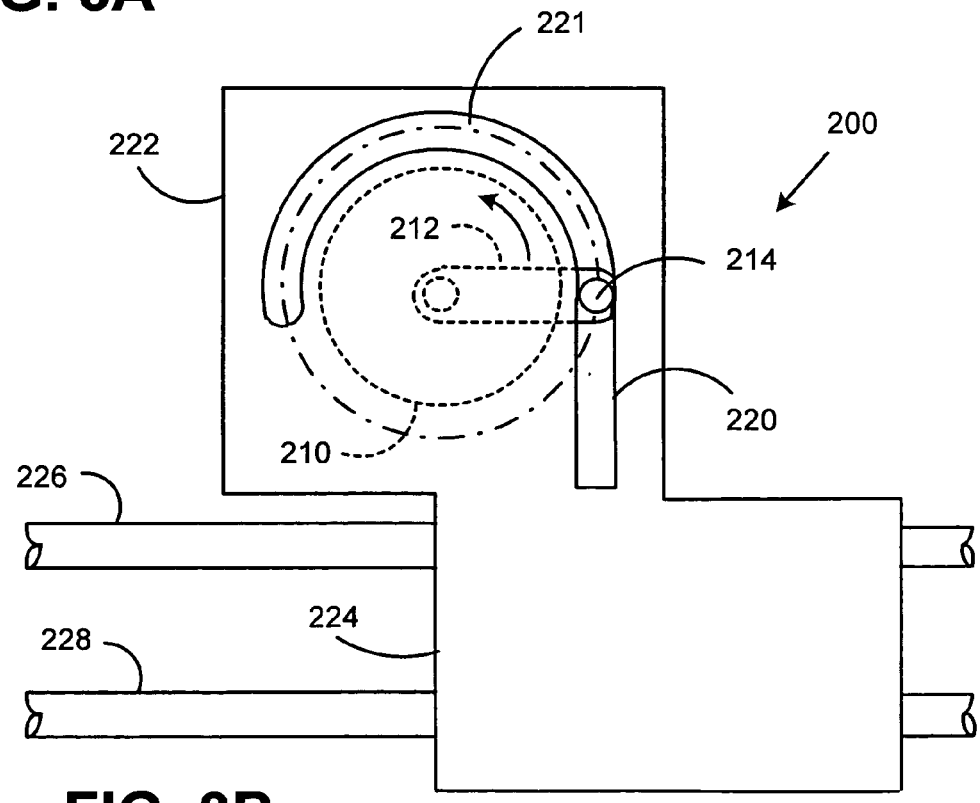
Figure 3C:
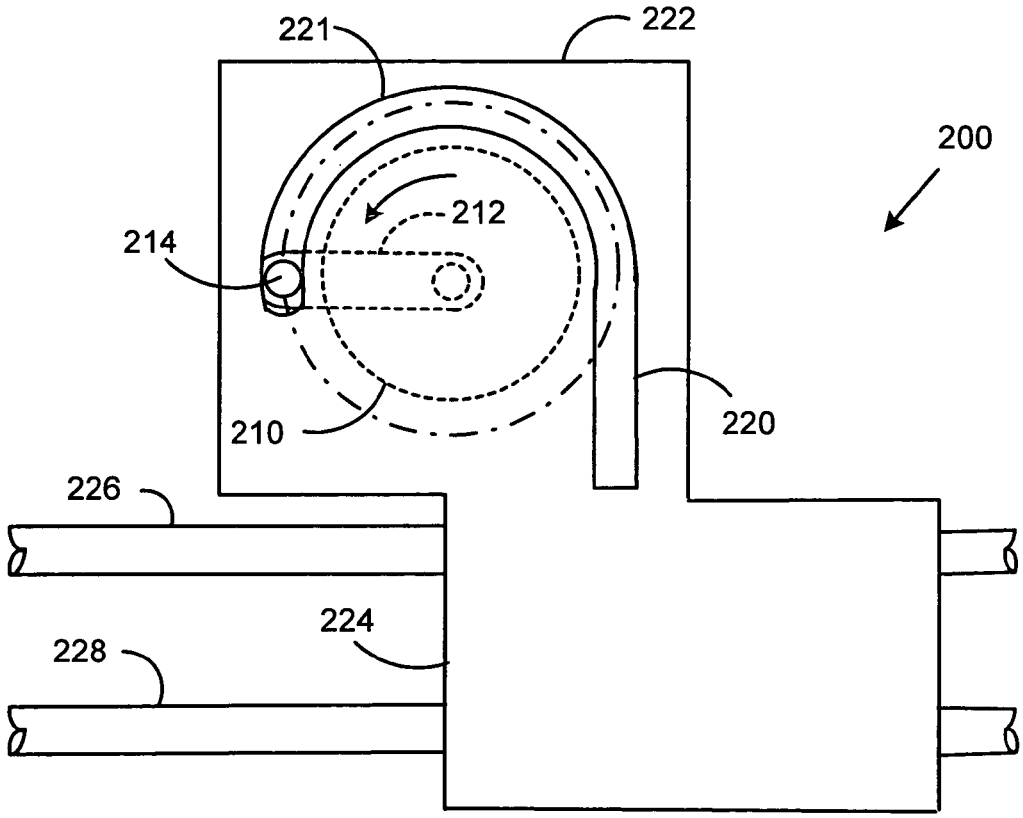

Referring to FIGS. 3A, 3B and 3C, a modified Scotch Yoke system 200 used to drive a first carriage 224 along guide rails 226, 228 according to an illustrative embodiment of the present application is shown. The mechanism differs from the standard Scotch Yoke mechanism and has a slot that resembles the shape of the letter J. The mechanism includes a slot 220 in the arm 222 of the carriage 224. The arm 222 or carriage 224 or other object attached to the arm is confined to move in a linear path on guide rails 226, 228 placed perpendicular to the slot 220. A pin 214 is connected to a crank shaft 212 that is driven by motor 210. The motor 210 drives the pin 214 in a circular path and it engages the slot 220 in the arm 222. In this embodiment, the slot 220 includes the linear portion and a semicircular portion 221. As the motor 210 moves the pin 214 along its circular path and in the linear portion of slot 220, it drives the carriage 224 or other object along the rails 226, 228. However, when the pin rotates through the second 180 degrees, the pin moves through the semicircular portion 221 of the slot 220 such that it moves freely in the slot and does not drive the arm 222.

As shown in a home position in FIG. 3A, When the pin 214 is rotated counterclockwise through the first 180 degrees of motor rotation, the first carriage or object 224 is moved to the right in direction A along rails 226, 228. As shown in FIG. 3B, the carriage is displaced into the moved position during the first 180 degree counterclockwise motor rotation. As shown in FIG. 3C, during the second 180 degrees of motor rotation in the same clockwise direction of rotation, the pin 214 simply moves along the arc 221 of the slot 220. Accordingly, the carriage 224 is not moved.

Figure 4A:
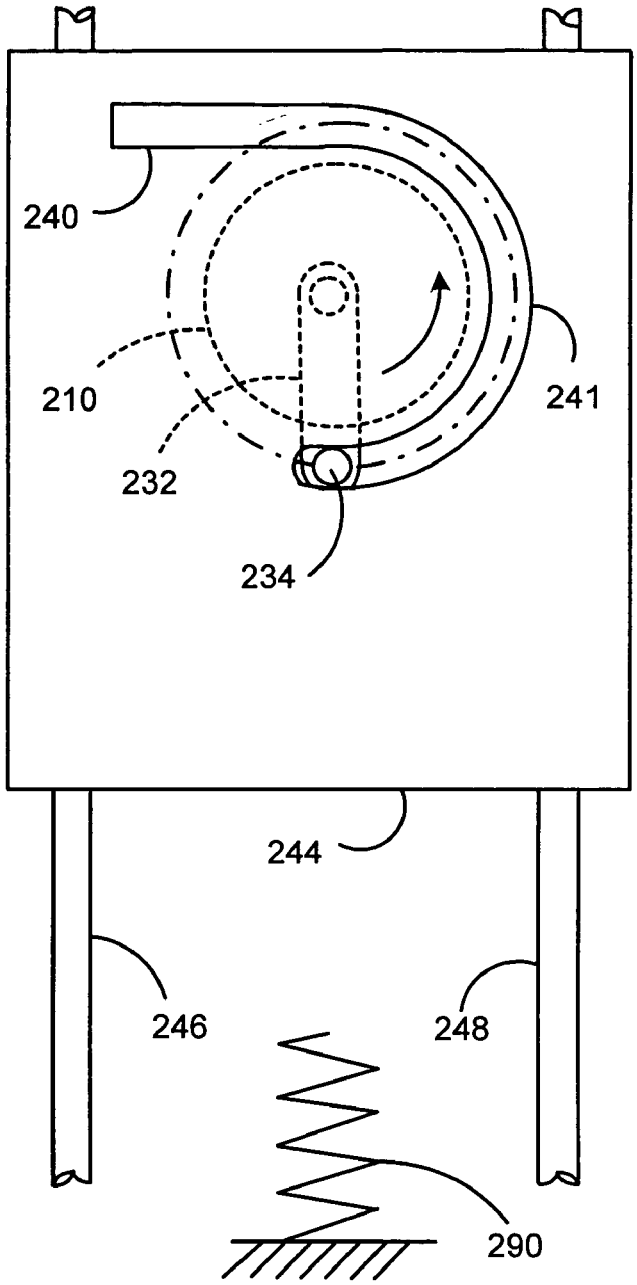
FIGS. 4A, 4B and 4C are schematic views of a modified Scotch Yoke used to drive a second carriage along guide rails according to an illustrative embodiment of the present application.
Figure 4B:
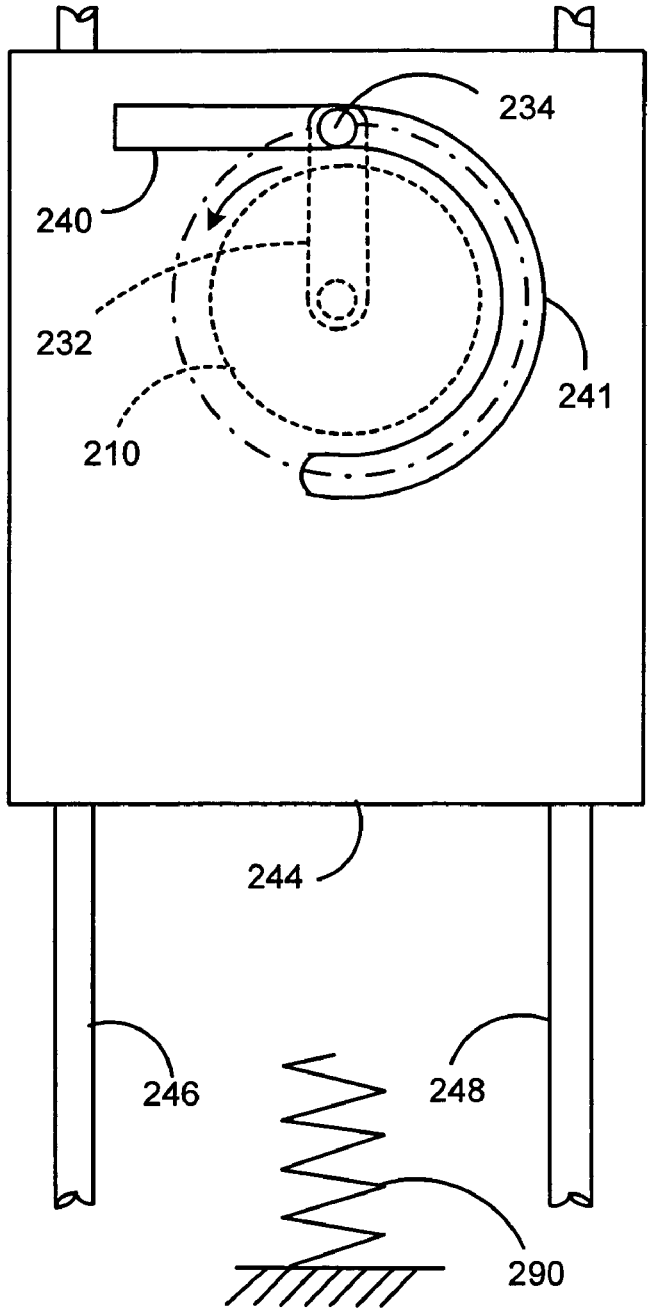
Figure 4C:
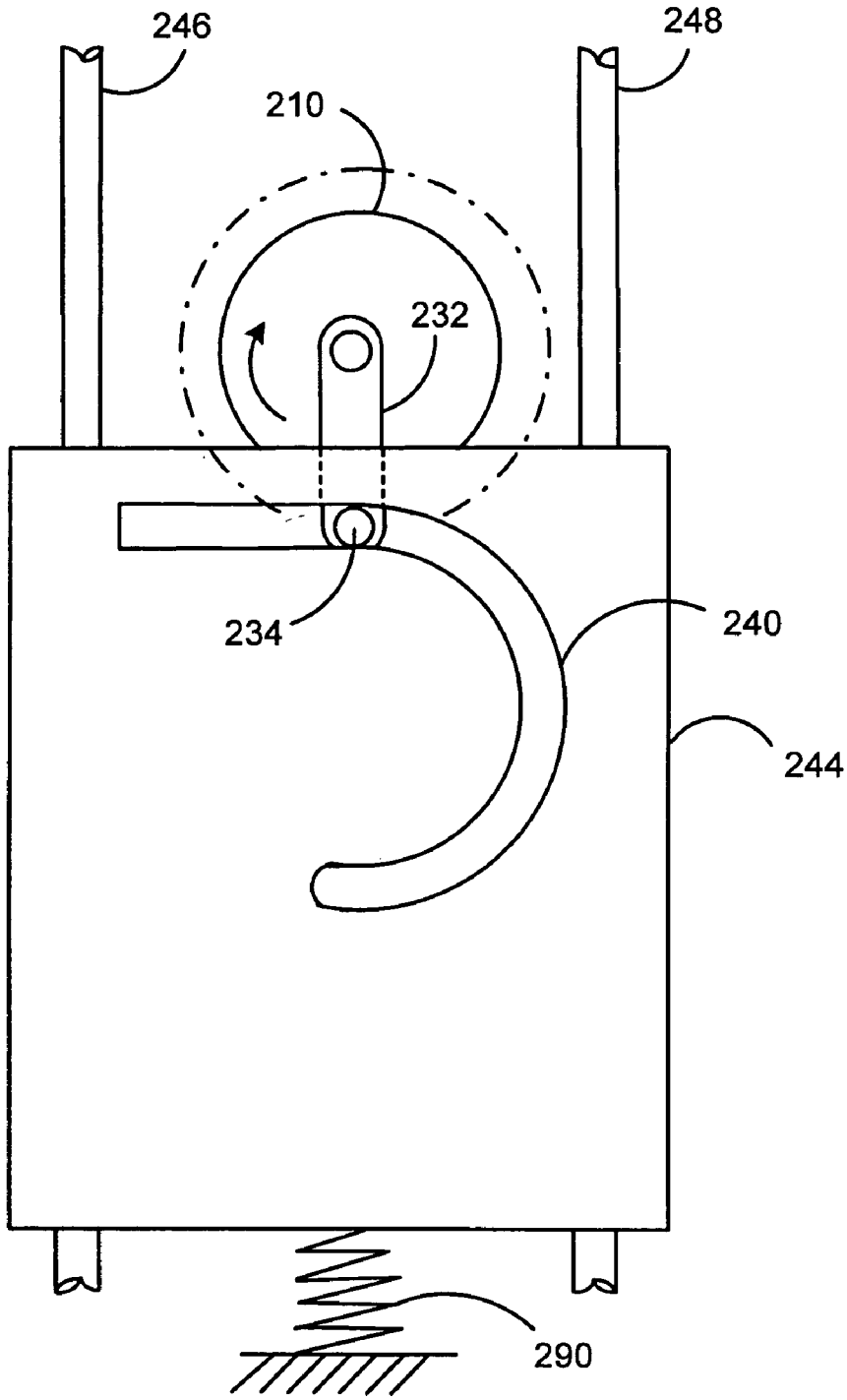

Referring to FIGS. 4A, 4B and 4C are schematic views of a modified Scotch Yoke used to drive a second carriage 244 along guide rails 246, 248 according to an illustrative embodiment of the present application.

A second object 244 is positioned with its axis of translation perpendicular to that of the first object and fitted with a modified J slot, such that it goes through a similar motion as the first object 224. However, the pin 234 that drives it with shaft 232 is located 90 degrees from the position of the pin 114 that drives the first object 224. As shown with the location of FIG. 4B, by locating the pin 234 in the J slot 240 of the second object 244, the first 180 degrees of motor rotation moves the pin along the arc 241 of the slot 240 without moving the second object 244. As shown with the location of FIG. 4C, the second 180 degrees of rotation displaces the second object 244 along its axis of travel along rails 246, 248.

As shown, a print head engaging a biasing spring 290 may be optionally utilized. To keep the print head in a fixed print position, the second object 324 or carriage compresses a spring 290 as it reaches the end of its linear travel along rails 326, 328 at the envelope path. This compression loads all of the mechanism to one side of the J shaped slot 320 to remove all clearances. The spring can be a rather heavy spring force since the pin has a toggle-like mechanical advantage as it arrives at or as it leaves the end position.

In the embodiments above, the system may operate with one carriage and one motor. In another embodiment, the pins of both drives are located as described above and in a common disk attached to a single motor shaft, the first 180 degrees of rotation of the motor shaft would move the first object while keeping the second object in place. During the second 180 degrees of counterclockwise rotation, the first object would stay in place and the second object would move. Reversing the direction of rotation of the motor brings the second object back to its original position and then moves the first object back to its original position.

Figure 5:
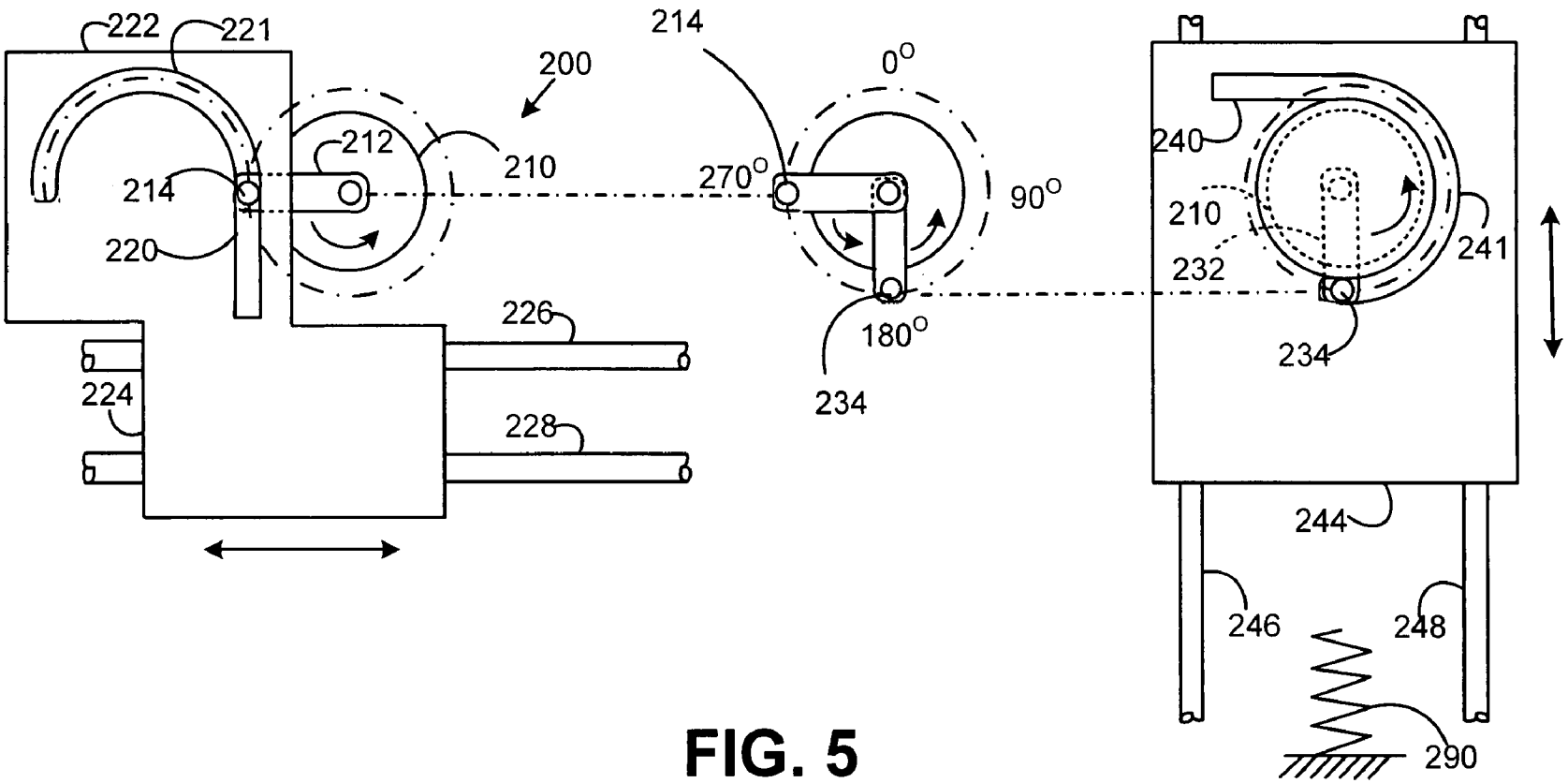
FIG. 5 is a schematic view of the modified Scotch Yoke system shown in FIGS. 3A-3C and FIGS. 4A-4C according to an illustrative embodiment of the present application.

Referring to FIG. 5, a schematic view of the modified Scotch Yoke system shown in FIGS. 3A-3C and FIGS. 4A-4C according to an illustrative embodiment of the present application is shown. Common motor 210 drives a first pin 214 in a first slot 220 in order to move a first carriage 222 and drives a second pin 234 in a second slot 240 in order to move a second carriage 244.

In an illustrative embodiment of the present application, a modified dual scotch yoke mechanism for translating a rotational motion of a motor includes a drive shaft for driving the rotational motion of the motor, a first pin operatively connected to the drive shaft, a first arm having a first slot, the first slot operatively connected to the first pin, a second pin operatively connected to the drive shaft, and a second arm having a second slot, the second slot operatively connected to the second pin. The first pin engages the first slot for a first portion of the rotational motion thereby driving the first arm in a linear motion, and the first pin moves freely in the first slot for a second portion of the rotational motion, wherein the first arm is not driven by the first pin during the second portion of the rotational motion. In a first alternative illustrative example of the modified dual scotch yoke mechanism described above in the present paragraph, the second pin engages the second slot for the second portion of the rotational motion thereby driving the second arm in a linear motion, and the second pin moves freely in the second slot for the first portion of the rotational motion, wherein the second arm is not driven by the second pin during the first portion of the rotational motion. In a second alternative illustrative example of the modified dual scotch yoke mechanism described above in the present paragraph, the second pin engages the second slot for a third portion of the rotational motion thereby driving the second arm in a linear motion, the second pin moves freely in the second slot for a fourth portion of the rotational motion, wherein the second arm is not driven by the second pin during the fourth portion of the rotational motion.

When the mechanism is utilized in an ink jet printer in an embodiment, the first object is a capping and wiping maintenance station and the second object is the print head or print head carriage. Therefore, the first 180 degrees of motor rotation uncaps the print head and moves the wiper blade across the face of the print head. The second 180 degrees of motor rotation moves the print head into the printing position. The motor can be reverse and the print head returns to the home position then the maintenance station returns home and caps the print head.

In an alternative embodiment, a maintenance station capping ramp may be utilized in a home position. As described above, the mechanical advantage of the pin can optionally be used on the first object or maintenance station as it returns to its home position. The mechanical advantage may be used to actuate the capping of the print head using a ramp feature on the base of the capping mechanism.

While the embodiments are described with reference to an ink jet printing system, the mechanisms described may be utilized in other systems as well.

The present application describes illustrative embodiments of a system and method for providing independent translational motion on two axes using one motor. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

What is claimed is:

1. A modified dual scotch yoke mechanism for translating a rotational motion of a motor comprising:
   - a drive shaft for driving the rotational motion of the motor;
   - a first pin operatively connected to the drive shaft;
   - a first arm having a first slot, the first slot operatively connected to the first pin for driving the first arm in a first axis;
   - a second pin operatively connected to the drive shaft;
   - a second arm having a second slot, the second slot operatively connected to the second pin for driving the second arm in a second axis; wherein
   - the first pin engages the first slot for a first portion of the rotational motion thereby driving the first arm in a linear motion; and
   - the first pin moves freely in the first slot for a second portion of the rotational motion, wherein the first arm is not driven by the first pin during the second portion of the rotational motion.

2. The modified dual scotch yoke mechanism according to claim 1, further comprising:
   - the second pin engages the second slot for the second portion of the rotational motion thereby driving the second arm in a linear motion; and
   - the second pin moves freely in the second slot for the first portion of the rotational motion, wherein the second arm is not driven by the second pin during the first portion of the rotational motion.

3. The modified dual scotch yoke mechanism according to claim 2, wherein:
   - the first portion of the rotational motion is approximately 180 degrees of rotational motion; and
   - the second portion of the rotational motion is approximately 180 degrees of rotational motion.

4. The modified dual scotch yoke mechanism according to claim 1, wherein:
   - the first slot comprises a slot in the shape of a letter J including a portion of the slot corresponding to a 180 degree arc of the first pin; and
   - the second slot comprises a slot in the shape of a letter J including a portion of the slot corresponding to a 180 degree arc of the second pin.

5. The modified dual scotch yoke mechanism according to claim 1, further comprising:

the second pin engages the second slot for a third portion of the rotational motion thereby driving the second arm in a linear motion; and the second pin moves freely in the second slot for a fourth portion of the rotational motion, wherein the second arm is not driven by the second pin during the fourth portion of the rotational motion.

6. An ink jet printing system comprising:

a maintenance station operatively connected to a first guide rail for moving into at least a first position and a second position;

a print head assembly operatively connected to a second guide rail for moving into at least a home position and a print position;

a modified dual scotch yoke mechanism for translating a rotational motion of a motor including:

a drive shaft for driving the rotational motion of the motor;

a first pin operatively connected to the drive shaft;

a first arm operatively connected to the maintenance station having a first slot, the first slot operatively connected to the first pin;

a second pin operatively connected to the drive shaft;

a second arm operatively connected to the print head assembly having a second slot, the second slot operatively connected to the second pin; wherein the first pin engages the first slot for a first portion of the rotational motion thereby driving the first arm in a linear motion; and the first pin moves freely in the first slot for a second portion of the rotational motion, wherein the first arm is not driven by the first pin during the second portion of the rotational motion.

7. The ink jet printing system according to claim 6, further comprising:

the second pin engages the second slot for the second portion of the rotational. motion thereby driving the second arm in a linear motion; and the second pin moves freely in the second slot for the first portion of the rotational motion, wherein the second arm is not driven by the second pin during the first portion of the rotational motion.

8. The ink jet printing system according to claim 7, wherein:

the first portion of the rotational motion is approximately 180 degrees of rotational motion; and the second portion of the rotational motion is approximately 180 degrees of rotational motion.

9. The ink jet printing system according to claim 8, wherein:

the first slot comprises a slot in the shape of a letter J including a portion of the slot corresponding to a 180 degree arc of the first pin; and the second slot comprises a slot in the shape of a letter J including a portion of the slot corresponding to a 180 degree arc of the second pin.

10. The ink jet printing system, according to claim 9, further comprising:

the second pin engages the second slot for a third portion of the rotational motion thereby driving the second arm in a linear motion; and the second pin moves freely in the second slot for a fourth portion of the rotational motion, wherein the second arm is not driven by the second pin during the fourth portion of the rotational motion.

11. The ink jet printing system, according to claim 10, further comprising:

a biasing device operatively connected to the print head when the print head is in the print position for biasing the print head to one side of the slot.

12. The ink jet printing system, according to claim 11, further comprising:

a ramp device operatively connected to the maintenance station when the maintenance station returns to the first position for capping the print head.

13. The ink jet printing system, according to claim 12, wherein, the maintenance station includes a wiper blade;

the print head includes a face portion;

a first 180 degrees of rotation in a first direction of the motor uncaps the print head and moves the maintenance station wiper blade across the face portion of the print head; and a second 180 degrees of rotation in the first direction moves the print head into the print position.

14. The ink jet printing system, according to claim 13, wherein, a first 180 degrees of rotation in a second direction that is opposite the first direction returns the print head assembly to the home position; and a second 180 degrees of rotation in the second direction moves the maintenance station into position to cap the print head.

15. A mailing machine including an ink jet printing system comprising:

a maintenance station operatively connected to a first guide rail for moving into at least a first position and a second position;

a print head assembly operatively connected to a second guide rail for moving into at least a home position and a print position;

a modified dual scotch yoke mechanism for translating a rotational motion of a motor including:

a drive shaft for driving the rotational motion of the motor;

a first pin operatively connected to the drive shaft;

a first arm operatively connected to the maintenance station having a first slot, the first slot operatively connected to the first pin;

a second pin operatively connected to the drive shaft;

a second arm operatively connected to the print head assembly having a second slot, the second slot operatively connected to the second pin; wherein the first pin engages the first slot for a first portion of the rotational motion thereby driving the first arm in a linear motion; and the first pin moves freely in the first slot for a second portion of the rotational motion, wherein the first arm is not driven by the first pin during the second portion of the rotational motion.

16. The mailing machine according to claim 15, further comprising:

the second pin engages the second slot for the second portion of the rotational motion thereby driving the second arm in a linear motion; and the second pin moves freely in the second slot for the first portion of the rotational motion, wherein the second arm is not driven by the second pin during the first portion of the rotational motion.

17. The ink jet printing system according to claim 16, wherein:

the first portion of the rotational motion is approximately 180 degrees of rotational motion; and the second portion of the rotational motion is approximately 180 degrees of rotational motion.

18. The ink jet printing system according to claim 17, wherein:

the first slot comprises a slot in the shape of a letter J including a portion of the slot corresponding to a 180 degree arc of the first pin; and the second slot comprises a slot in the shape of a letter J including a portion of the slot corresponding to a 180 degree arc of the second pin.

19. The ink jet printing system, according to claim 18, further comprising:

the second pin engages the second slot for a third portion of the rotational motion thereby driving the second arm in a linear motion; and the second pin moves freely in the second slot for a fourth portion of the rotational motion, wherein the second arm is not driven by the second pin during the fourth portion of the rotational motion.

20. The ink jet printing system, according to claim 19, further comprising:

a biasing device operatively connected to the print head when the print head is in the print position for biasing the print head to one side of the slot.

* * * * *